US012011645B2

(12) United States Patent
Lawlor

(10) Patent No.: US 12,011,645 B2
(45) Date of Patent: Jun. 18, 2024

(54) GOLF TEE

(71) Applicant: Ace Golf Tee Ltd., Dublin (IE)

(72) Inventor: Patrick Lawlor, Dublin (IE)

(73) Assignee: Ace Golf Tee Ltd., Dublin (IE)

( * ) Notice: Subject to any disclaimer, the term of this patent is extended or adjusted under 35 U.S.C. 154(b) by 0 days.

(21) Appl. No.: 18/011,677

(22) PCT Filed: Jun. 21, 2021

(86) PCT No.: PCT/EP2021/066871
§ 371 (c)(1),
(2) Date: Dec. 20, 2022

(87) PCT Pub. No.: WO2021/259871
PCT Pub. Date: Dec. 30, 2021

(65) Prior Publication Data

US 2023/0256307 A1 Aug. 17, 2023

(30) Foreign Application Priority Data

Jun. 22, 2020 (GB) ..... 2009457

(51) Int. Cl.
*A63B 57/13* (2015.01)
*A63B 57/15* (2015.01)

(52) U.S. Cl.
CPC ..... *A63B 57/13* (2015.10); *A63B 57/15* (2015.10)

(58) Field of Classification Search
CPC ..... A63B 57/10; A63B 57/13; A63B 57/15
See application file for complete search history.

(56) References Cited

U.S. PATENT DOCUMENTS 1,623,119 A * 4/1927 Graham ..... A63B 57/13 473/391
2,146,736 A 2/1939 Hammond
2,470,817 A 5/1949 Hendricks
3,112,111 A * 11/1963 Bennett ..... A63B 57/10 473/391
3,506,263 A * 4/1970 Arrington ..... A63B 57/10 473/401

(Continued)

FOREIGN PATENT DOCUMENTS

CN 101199896 A 6/2008
GB 2334218 A 8/1999

(Continued)

OTHER PUBLICATIONS

International Search Report and Written Opinion dated Oct. 1, 2021 in corresponding Application No. PCT/EP2021/066871.

(Continued)

*Primary Examiner* — Steven B Wong
(74) *Attorney, Agent, or Firm* — Vitale, Vickrey, Niro, Solon & Gasey LLP

(57) ABSTRACT

A golf tee 10 comprising an upper section 11 configured to receive a ball and a lower section 12 configured to engage the ground. The upper and lower sections 11, 12 are movably and/or releasably engagable with respect to each other such that, in use, the upper section 11 moves and/or becomes detached from the lower section 12 should a golf club contact the upper portion 11 and/or should a ball positioned on the upper section 11 be struck by a golf club.

18 Claims, 10 Drawing Sheets

(56) References Cited

U.S. PATENT DOCUMENTS

| | | | | | |
|---|---|---|---|---|---|
| 4,418,916 | A * | 12/1983 | Matsuura | A63B 57/12 | 473/396 |
| 4,516,780 | A * | 5/1985 | Tabet | A63B 57/13 | 473/398 |
| D279,121 | S * | 6/1985 | Wampler | D21/717 | |
| 4,524,974 | A * | 6/1985 | Matsuura | A63B 57/10 | 473/396 |
| 5,242,170 | A * | 9/1993 | Ward | A63B 57/10 | 473/401 |
| 6,899,644 | B1 * | 5/2005 | Song | A63B 57/13 | 473/397 |
| 7,374,501 | B2 * | 5/2008 | Lu | A63B 60/46 | 473/396 |
| 8,439,771 | B1 * | 5/2013 | Fleming | A63B 57/13 | 473/397 |
| 9,833,672 | B1 * | 12/2017 | Montejo | A63B 57/203 | |
| 2007/0111825 | A1 * | 5/2007 | Lee | A63B 57/12 | 473/396 |
| 2007/0219022 | A1 * | 9/2007 | Lee | A63B 57/13 | 473/391 |
| 2007/0270246 | A1 * | 11/2007 | Salmon | A63B 57/10 | 473/397 |
| 2008/0064532 | A1 * | 3/2008 | Lee | A63B 57/12 | 473/396 |
| 2013/0310200 | A1 * | 11/2013 | Nelson | A63B 57/10 | 473/401 |

FOREIGN PATENT DOCUMENTS

| | | | | |
|---|---|---|---|---|
| JP | S51108765 | U | 8/1976 | |
| KR | 20050090599 | A | 9/2005 | |
| KR | 20100064010 | A | 6/2010 | |
| KR | 20110061050 | A | 6/2011 | |
| WO | WO-9425119 | A1 * | 11/1994 | A63B 57/10 |
| WO | 2004101080 | A1 | 11/2004 | |

OTHER PUBLICATIONS

Search Report dated Dec. 11, 2020 in corresponding Application No. GB2009457.9.

* cited by examiner

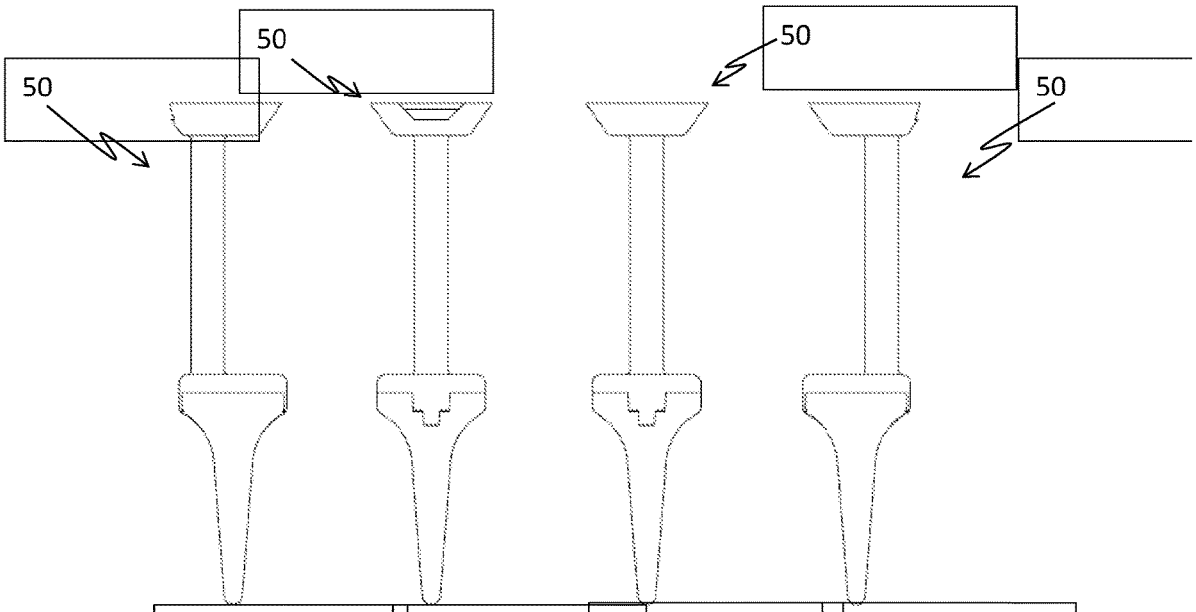
Figure 10 | Figure 11 | Figure 12 | Figure 13
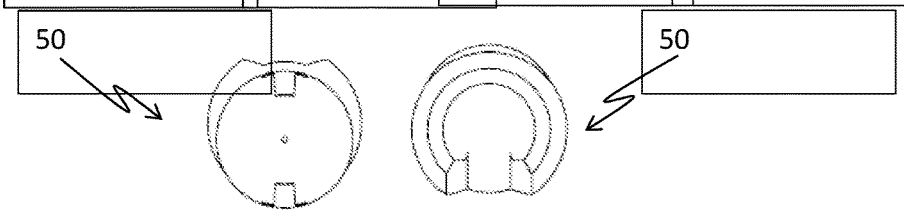
Figure 14 | Figure 15
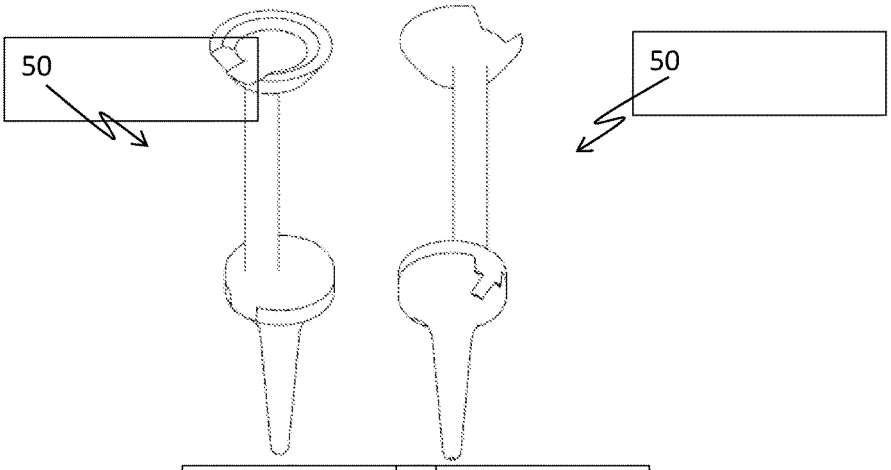
Figure 16 | Figure 17

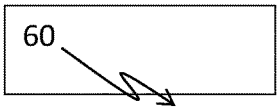
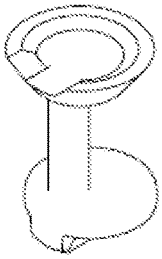
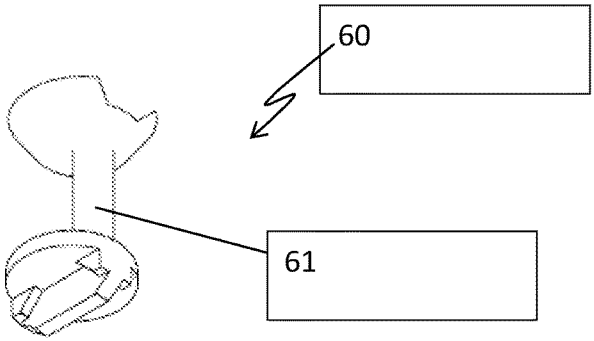
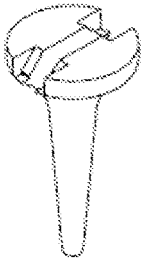
Figure 18
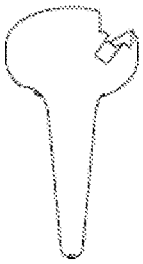
Figure 19
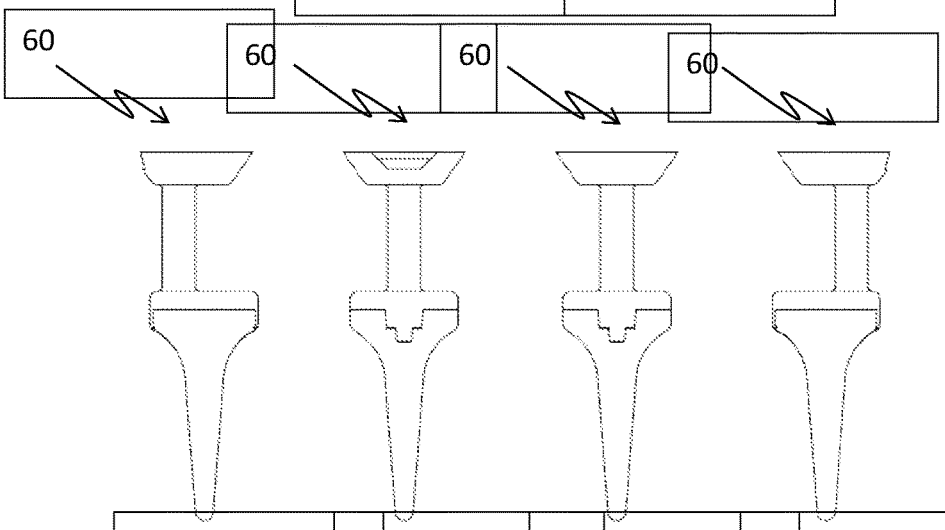
Figure 20 Figure 21 Figure 22 Figure 23
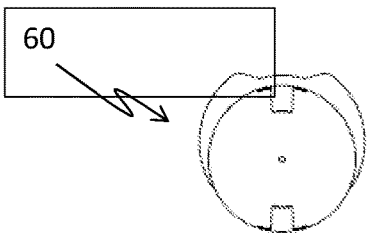
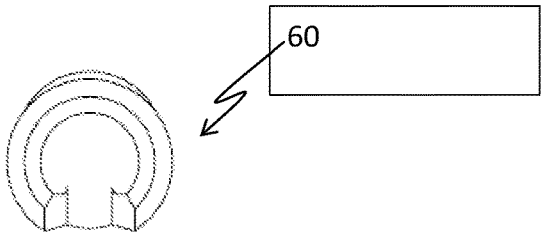
Figure 24 Figure 25

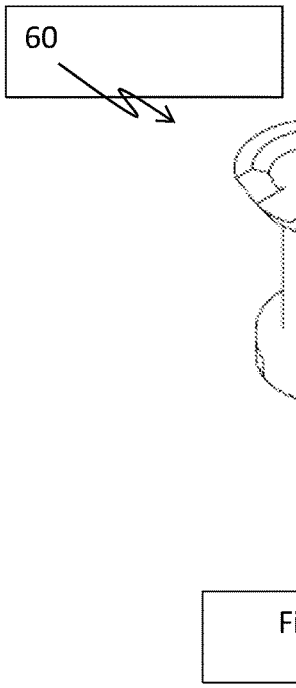
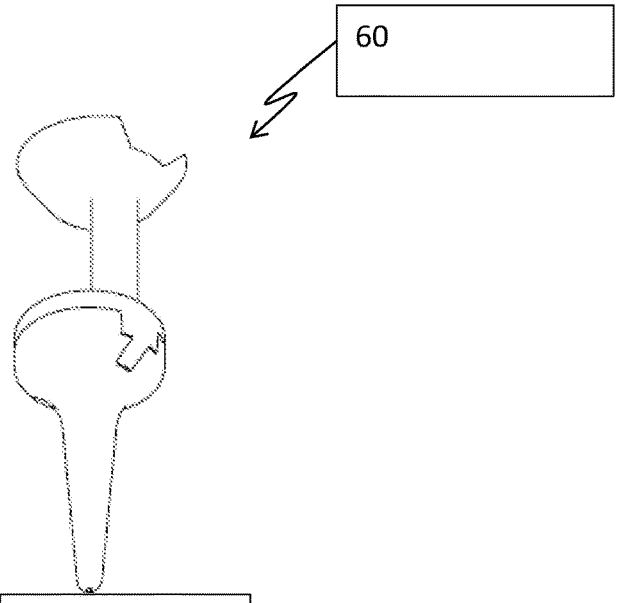
Figure 26 Figure 27
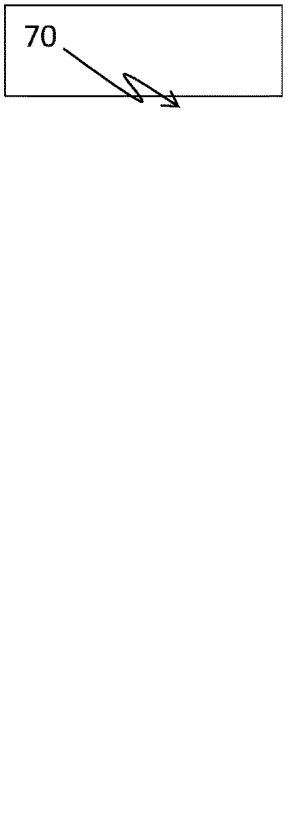
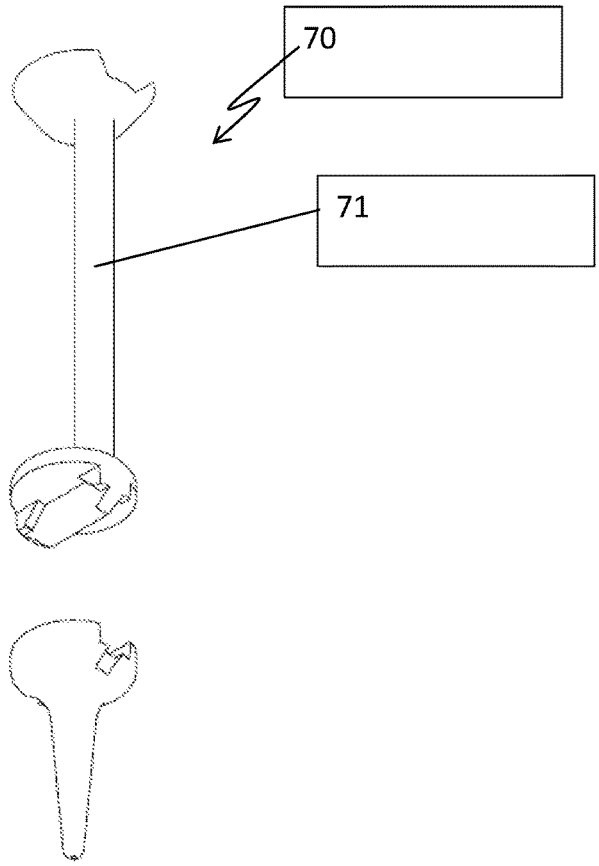
Figure 28 Figure 29

GOLF TEE

This patent application is a 35 U.S.C 371 national stage application of International Patent Application No. PCT/EP2021/066871, filed on Jun. 21, 2021, which claims priority to Great Britain Patent Application No. 2009457.9, filed on Jun. 22, 2020. All of these disclosures are hereby expressly incorporated by reference as part of the present disclosure as if fully set forth herein.

FIELD OF THE INVENTION

This invention relates to a golf tee and in particular to a golf tee for improving the interaction between said golf tee and a golf club/ball.

BACKGROUND OF THE INVENTION

Golf is a highly technical sport wherein small variances in swing, equipment, or technique can result in large variances in the results achieved. For most golfers, from beginner to professional, achieving consistent impact and thus controlling ball flight is a key aim. Many factors influence impact and ball flight and one of these factors is the complex interaction between the ground, the golf tee, the ball, and the golf club as it strikes the ball from the tee. Traditional golf tees comprise a single piece design having a centred shaft insertable into the ground and a cupped ball holder which retains the ball at a distance above the ground suitable for striking. In such a design, the entire tee is anchored to the ground and as such, should the player strike the tee, the resistance force provided by this anchoring to the ground is transferred to the clubface of the golf club, which can impact the path, speed, impact location, and resultantly the flight of the ball. Moreover, even if a player only strikes the ball from the tee without striking the tee itself, the ground resistance is still imparted to the golf club via the golf ball, again impacting the key strike parameters.

It is desirable to provide a golf tee which provides minimal interference with or resistance against the clubface of a golf club.

SUMMARY OF THE INVENTION

According to the invention there is provided a golf tee comprising: an upper section configured to receive a ball; a lower section configured to engage the ground; wherein the upper and lower sections are movably and/or releasably engagable with respect to each other such that, in use, the upper section moves and/or becomes detached from the lower section should a golf club contact the upper portion and/or should a ball positioned on the upper section be struck by a golf club.

Advantageously, movement or detachment of the upper section relative to the lower section upon striking the ball or the tee prevents excessive resistance from the tee affecting the speed, path, or follow through of a users golf swing, and/or direction/flight of the ball.

Preferably, the golf tee comprises movable and/or releasable engagement means operable between the upper and lower sections.

Ideally, the movable and/or releasable engagement means is, in use, at approximately ground level and most preferably just above ground level.

Ideally, the upper section comprises first and second portions, the first portion of the upper section being configured to receive a ball.

Preferably, the lower section comprises first and second portions, at least the first portion of the lower section being configured to engage with the ground.

Ideally, the movable and/or releasable engagement means is locatable at or between the respective second portions of the upper and lower sections such that the upper section is movably and/or releasably engageable with respect to the lower section via the movable and/or releasable engagement means.

Preferably, the movable and/or releasable engagement means are releasable engagement means comprising a first releasable engagement element thereof on the upper section and a corresponding second releasable engagement element thereof on the lower section.

Ideally, the golf tee comprises a pre-strike configuration wherein the releasable engagement means retain the upper section and lower section together to form a unitary tee which is engageable with the ground via the lower section and may receive a ball via the upper section and present said ball for striking by a user.

Preferably, the golf tee comprises a post-strike configuration wherein, upon a user striking a ball located on the upper section, or striking the upper section of the golf tee with a golf club, the upper section detaches from the lower section.

Advantageously, as the upper section detaches from the lower section upon striking of a golf ball from the golf tee, the possibility that the ground anchored lower section could negatively impact the swing of a golfer by providing resistance as the ball is struck from the golf tee is greatly reduced. This is in contrast to traditional golf tees wherein the resistance provided by the ground is transferred to the ball receiving portion of the tee upon striking the ball and as such this resistance may impact swing path, speed, follow through, and/or flight of the ball.

Ideally, the releasable engagement means is optimised such that the level of engagement between the upper and lower sections is of sufficient strength in the pre-strike configuration to form a unitary tee capable of supporting a ball at a distance from the ground.

Preferably, the level of engagement between the upper and lower sections is sufficiently releasable such that the upper section detaches from the lower section upon the upper section being subjected to a force level representative of a golf club striking a ball from the golf tee.

Ideally, the releasable engagement means comprises an interlocking releasable engagement arrangement comprising the first releasable engagement element thereof on the upper section and the second releasable engagement element thereof on the lower section.

Preferably, the interlocking releasable engagement arrangement is a friction fit releasable engagement arrangement.

Ideally, the friction fit releasable arrangement is optimised such that the friction level between the upper and lower sections is sufficient in the pre-strike configuration to form a unitary tee capable of supporting a ball at a distance from the ground.

Preferably, the friction fit releasable arrangement is optimised such that the friction level between the upper and lower sections is such that the upper section detaches from the lower section upon the upper section being subjected to a force level representative of a golf club striking a ball from the golf tee.

Ideally, the level of friction is such that, in use, the upper section detaches from the lower section before the upper section provides any resistance force to a golf club as it strikes a ball from the golf tee and travels past the golf tee.

Preferably, the interlocking releasable engagement arrangement comprises correspondingly shaped protrusion and recessed features locatable on the upper and lower sections.

Ideally, the first releasable engagement element of the interlocking releasable engagement arrangement comprises a protrusion feature locatable on the second portion of the upper section.

Preferably, the second releasable engagement element of the interlocking releasable engagement arrangement comprises a recessed feature locatable on the second portion of the lower section.

Ideally, the protrusion feature and recessed feature are correspondingly shaped and dimensioned such that insertion of the protrusion feature into the recessed feature releasably retains the upper section in the lower section.

Preferably, the protrusion feature and recessed feature are shaped to encourage detachment of the upper section from the lower section when a detachment force is imparted to the upper section, the direction of said detachment force being generally from a rearward side of the golf tee.

Ideally, the rearward side of the golf tee is defined as the side form which, in use, a golf club would approach to strike a ball from the tee.

Preferably, the forward side of the golf tee is defined as the side opposing the rearward side, and/or the side of the golf tee from which a golf ball travels once struck from the golf tee.

Ideally, the protrusion feature comprises a main body portion extending generally from a rearward side of the tee to the forward side of the tee.

Preferably, the recessed feature comprises a main channel portion, corresponding to the main body portion, and extending generally from a rearward side of the tee to the forward side of the tee.

Ideally, the main channel portion is configured to receive the main body portion.

Preferably, the protrusion and recessed features each comprise sloped portions locatable along each longitudinal side of their respective main body and main channel portions.

Ideally, the sloped portions comprise sloped surfaces which each extend longitudinally in a direction generally from the rearward side of the tee to the forward side of the tee.

Preferably, the sloped portions of the protrusion feature slope generally in a direction from an underside surface of the second portion of the upper section, outwardly from said surface to from sloped protrusion portions.

Ideally, the sloped portions of the recessed feature slope generally in a direction from an upper surface of the second portion of the lower section, inwardly from said surface to from sloped recessed portions in said surface.

Preferably, the sloped portions of the protrusion and recessed features are correspondingly shaped such that the sloped surfaces of the protrusion feature abut and/or generally align with the sloped surfaces of the recessed feature when the upper and lower portions are engaged via the releasable engagement means.

Ideally, the sloped portions are shaped and dimensioned such that they encourage the upper section to rotate forwards and detach from the lower section upon a ball being struck from the tee of upon the upper section being struck by a golf club.

Preferably, the first and second portions of the upper and lower sections are locatable at first and second ends thereof.

Ideally, the second portion of the lower section is located at a second end thereof, the second releasable engagement element being locatable at said second end.

Preferably, the lower section comprises a shaft which extends generally centrally from the underside of the second releasable engagement element to a first end of the lower section distal the second end thereof.

Ideally, the lower section, in use, is insertable into the ground such that at least the shaft thereof is at or below ground level.

Preferably the lower section is insertable into the ground such that the entirety thereof is at or below ground level.

Advantageously, as the lower section is all or mostly at or below ground level, the likelihood of a user striking the lower section during their golf swing is greatly reduced. Thus the possibility that the ground anchored lower section could negatively impact the clubhead by providing resistance as the ball is struck from the golf tee is greatly reduced. This is in contrast to traditional golf tees wherein the resistance provided by the ground is transferred to the ball receiving portion of the tee during striking of the ball and as such this resistance may impact the clubhead and resultantly the swing path, speed, follow through, and/or flight of the ball.

Ideally, the second portion of the upper section is located at a second end thereof, the first releasable engagement element being locatable at said second end.

Preferably, a ball receiving feature is locatable at a first end of the upper section distal the second end thereof.

Ideally, the upper section further comprises a shaft extending between the first releasable engagement element and the ball receiving feature.

Preferably, the shaft of the upper section is laterally offset from the centre of an upper surface of the first releasable engagement element.

Ideally, the shaft of the upper section is locatable between the centre of the upper surface of the first releasable engagement element and the forward edge thereof.

Preferably, the shaft of the upper section is locatable approximately 4 millimetres (mm) forward of the centre of the upper surface of the first releasable engagement element.

Ideally, the shaft of the upper section is locatable forward of the shaft of the lower section when the upper and lower sections are engaged in the pre-strike configuration.

Preferably, the shaft of the upper section is locatable approximately 4 millimetres (mm) forward of the shaft of the lower section when the upper and lower section are engaged in the pre-strike configuration.

Ideally, the shaft of the upper section is locatable at a forward edge of the upper section.

Advantageously, the shaft of the upper section is positioned such that the likelihood of a user striking said shaft during their golf swing is reduced, thus the effect that striking said shaft would have on the path, speed, and/or follow through of a users golf swing is diminished, as is any resulting impact on the flight of the ball.

Preferably, the ball receiving feature is a generally circular ball receiving feature.

Ideally, the ball receiving feature is a cup shaped ball receiving feature having raised side walls defining a ball receiving cup therein.

Ideally, the outer circumference of the ball receiving feature forms the widest portion of the golf tee.

Preferably, the forward side of the ball receiving feature comprises an opening in the raised side walls thereof.

Advantageously, a ball, once struck, may travel from the golf tee through the opening and thus experience less resistance as it leaves the golf tee which could slow or alter the path/flight of the ball.

Ideally, the golf tee comprises indication means to aid a user in aligning the golf tee in order that the golf tee is aligned such that the rearward side of the golf tee is facing in a direction from which the user intends to strike the ball, and/or the forward side of the golf tee is facing in a direction in which the user intends a struck ball to travel.

Preferably, the indication means aids a user to align the golf tee such that the longitudinal direction of the main body portion and the main channel portion generally align with the intended swing path of a user such that the user intends to generally swing along said longitudinal direction.

Ideally, the opening in the ball receiving feature acts as the indication means.

Preferably, the opening in the ball receiving feature is aligned with the forward ends of the main body and main channel portions.

Preferably, the upper section can be provided in a variety of heights.

Advantageously, the overall height of the golf tee can be made suitable for use by different golfers having different tee height preferences, be adapted depending on shot type, or adapted depending on club choice/geometry.

Ideally, the different heights are achieved by providing a plurality of upper sections having shafts of differing lengths.

According to a second aspect of the invention there is provided an upper section for a golf tee, the upper section being configured to receive a ball and being configured for movable and/or releasable engagement with a lower section of a golf tee which is configured to engage the ground, wherein, in use, the upper section moves and/or becomes detached from the lower section should a golf club contact the upper portion and/or should a ball positioned on the upper section be struck by a golf club.

BRIEF DESCRIPTION OF THE DRAWINGS

An embodiment of the invention is now described by way of example and with reference to the accompanying drawings in which:

FIG. 10 is a first side view of the golf tee of FIG. 8 showing the upper and lower sections thereof in engagement with each other;

FIG. 11 is a front view of the golf tee of FIG. 10;

FIG. 12 is a rear view of the golf tee of FIG. 10;

FIG. 13 is a second side view of the golf tee of FIG. 10;

FIG. 14 is a bottom view of the golf tee of FIG. 10;

FIG. 15 is a top view of the golf tee of FIG. 10;

FIG. 16 is a perspective view from above of the golf tee of FIG. 8 showing the upper and lower sections thereof in engagement with each other;

FIG. 17 is a perspective view from below of the golf tee of FIG. 16;

FIG. 18 is a perspective view from above of a further embodiment of a golf tee showing the upper and lower sections thereof in a detached configuration;

FIG. 19 is a perspective view from below of the golf tee of FIG. 18;

FIG. 20 is a first side view of the golf tee of FIG. 18 showing the upper and lower sections thereof in engagement with each other;

FIG. 21 is a front view of the golf tee of FIG. 20;

FIG. 22 is a rear view of the golf tee of FIG. 20;

FIG. 23 is a second side view of the golf tee of FIG. 20;

FIG. 24 is a bottom view of the golf tee of FIG. 20;

FIG. 25 is a top view of the golf tee of FIG. 20;

FIG. 26 is a perspective view from above of the golf tee of FIG. 18 showing the upper and lower sections thereof in engagement with each other;

FIG. 27 is a perspective view from below of the golf tee of FIG. 26;

FIG. 28 is a perspective view from above of a further embodiment of a golf tee showing the upper and lower sections thereof in a detached configuration;

FIG. 29 is a perspective view from below of the golf tee of FIG. 28;

DETAILED DESCRIPTION OF THE DRAWINGS

Figure 1:
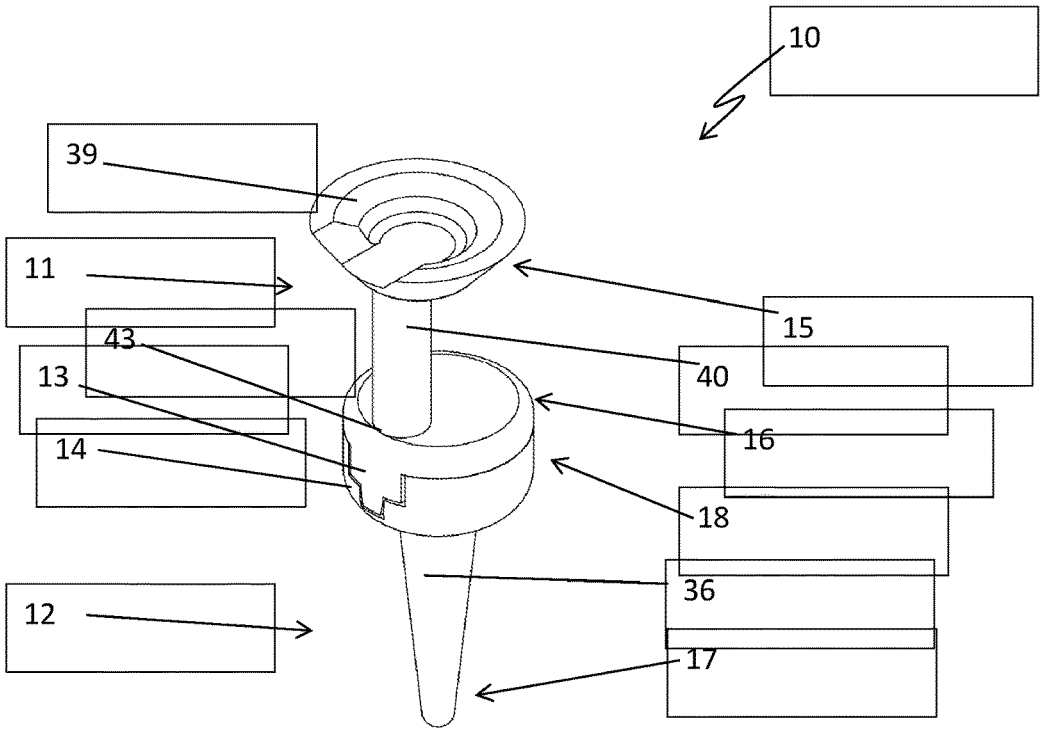
FIG. 1 is a perspective view of a golf tee comprising upper and lower sections in engagement with each other to form a unitary golf tee.

The present teaching will now be described with reference to an exemplary golf tee. It will be understood that the exemplary golf tee is provided to assist in an understanding of the present teaching and are not to be construed as limiting in any fashion. Furthermore, elements or components that are described with reference to any one Figure may be interchanged with those of other Figures or other equivalent elements without departing from the spirit of the present teaching.

Referring now to the Figures there is illustrated a golf tee 10 comprising an upper section 11 configured to receive a ball and a lower section 12 configured to engage the ground. The upper and lower sections 11, 12 are releasably engagable with respect to each other such that, in use, the upper section 11 becomes detached from the lower section 12 should a golf club contact the upper portion 11 and/or should a ball positioned on the upper section 11 be struck by a golf club. Advantageously, detachment of the upper section 11 relative to the lower section 12 upon striking the ball or the tee 10 prevents excessive resistance from the tee 10 effecting the speed, path, or follow through of a users golf swing, and/or flight of the ball. It should be understood, that whilst in the preferable embodiment the upper section 11 becomes detached form the lower section 12 during use, embodiments are envisaged wherein the connection between the upper and lower sections 11, 12 is a movable connection such that the upper section 11 remains attached to the lower section 12 should a golf club contact the upper portion 11 and/or should a ball positioned on the upper section 11 be struck by a golf club, but has freedom to move such that the upper section 11 does not provide significant resistance to the golf club as the golf club strikes the ball or the upper section 11. In such embodiments, the movable connection may be a rotatable/pivotable connection, or there may be an elastically deformable material forming the connection between the upper and lower sections 11, 12.

The golf tee 10 comprises a releasable engagement arrangement 13, 14 operable between the upper and lower sections 11, 12. The upper section 11 comprises first and second ends 15, 16, the first end 15 of the upper section being configured to receive a ball. The lower section 12 comprises first and second ends 17, 18, and at least the first end 17 of the lower section 12 is configured to engage with the ground. The releasable engagement arrangement 13, 14 is locatable at or between the respective second ends 16, 18 of the upper and lower sections 11, 12 such that the upper section 11 is releasably engageable with respect to the lower section 12 via the releasable engagement arrangement 13, 14. In the preferred embodiment as shown in the drawings, the releasable engagement arrangement 13, 14 comprises a first releasable engagement element 13 thereof on the upper section 11 and a corresponding second releasable engagement element 14 thereof on the lower section 12.

The golf tee 10 comprises a pre-strike configuration (as can be best viewed in FIG. 1) wherein the releasable engagement arrangement 13, 14 retains the upper section 11 and lower section 12 together to form a unitary tee 10 which is engageable with the ground via the lower section 12 and may receive a ball via the upper section 11 and present said ball for striking by a user. The golf tee 10 also comprises a post-strike configuration wherein, upon a user striking a ball located on the upper section 11, or striking the upper section 11 with a golf club, the upper section 11 detaches from the lower section 12. Advantageously, as the upper section 11 detaches from the lower section 12 upon striking of a golf ball from the golf tee 10, the possibility that the ground anchored lower section 12 could negatively impact the swing of a golfer by providing resistance as the ball is struck from the golf tee is greatly reduced. This is in contrast to traditional golf tees wherein the resistance provided by the ground is transferred to the ball receiving portion of the tee and as such this resistance may impact swing path, speed, follow through, and/or flight of the ball. The anchoring force force/resistance of the ground in a traditional tee is directly connected to the ball receiving portion thereof in an uninterrupted manner throughout use of such a tee and any disconnect would require enough force to break a traditional tee.

The releasable engagement arrangement 13, 14 is optimised such that the level of engagement between the upper and lower sections 11, 12 is of sufficient strength in the pre-strike configuration to form a unitary tee 10 capable of supporting a ball at a distance from the ground. In addition, the level of engagement between the upper and lower sections 11, 12 is sufficiently releasable such that the upper section 11 detaches from the lower section 12 upon the upper section 11 being subjected to a force level representative of a golf club striking a ball from the golf tee 10. In the preferred embodiment, as shown in the drawings, the releasable engagement arrangement 13, 14 comprises an interlocking releasable engagement 13, 14 arrangement having the first releasable engagement element 13 thereof on the upper section and the second releasable engagement element 14 thereof on the lower section. The interlocking releasable engagement arrangement 13, 14 is a friction fit releasable engagement arrangement 13, 14 such that the friction between the first and second releasable engagement elements 13, 14 acts to retain the upper and lower sections 11, 12 together in the pre-strike configuration.

The friction fit releasable arrangement 13, 14 is optimised such that the friction level between the upper and lower sections 11, 12 is sufficient in the pre-strike configuration to form a unitary tee capable of supporting a ball at a distance from the ground. The friction fit releasable arrangement 13, 14 is also optimised such that the friction level between the upper and lower sections 11, 12 is such that the upper portion 11 detaches from the lower portion 12 upon the upper section 11 being subjected to a force level representative of a golf club striking a ball from the golf tee. The level of friction is such that, in use, the upper section 11 detaches from the lower section 12 before the upper section 11 provides any resistance force to a golf club as it strikes a ball from the golf tee and travels past the golf tee. Without detachment, the anchoring force of the lower section 12 would be imparted to the golf club via the upper section 11. In the embodiment of the drawings, the interlocking releasable engagement arrangement 13, 14 comprises correspondingly shaped protrusion and recessed features 19, 20 locatable on the upper and lower sections 11, 12 respectively. The first releasable engagement element 13 of the interlocking releasable engagement arrangement comprises a protrusion feature 19 locatable on the second end 16 of the upper section 11. The second releasable engagement element 14 of the interlocking releasable engagement arrangement comprises a recessed feature 20 locatable on the second end 18 of the lower section 12. The protrusion feature 19 and recessed feature 20 are correspondingly shaped and dimensioned such that insertion of the protrusion feature 19 into the recessed feature 20 releasably retains the upper section 11 in the lower section 12. The protrusion feature 19 and recessed feature 20 are shaped to encourage detachment of the upper section 11 from the lower section 12 when a detachment force is imparted to the upper section 11, the direction of said detachment force being generally from a rearward side 21 of the golf tee 10. The rearward side 21 of the golf tee is defined as the side 21 form which, in use, a golf club would approach to strike a ball from the tee 10. The forward side 22 of the golf tee 10 is defined as the side opposing the rearward side 21, and the side of the golf tee 10 from which a golf ball travels once struck from the golf tee 10. The protrusion feature 19 and recessed feature 20 are shaped such that detachment of the upper section 11 in a direction generally aligned with the path of a golf club when striking a ball from the tee 10 is encouraged. Detachment in a direction to either lateral side 23, 24 of the golf tee 10 is discouraged by the shape of the protrusion feature 19 and recessed feature 20. More specifically, the protrusion feature 19 comprises a main body portion 25 extending generally from a rearward side 22 of the tee to the forward side 21 of the tee. The recessed feature 20 comprises a main channel portion 26, corresponding to the main body portion 25 of the protrusion feature 19 and extending generally from a rearward side 22 of the tee to the forward side 21 of the tee. The main channel portion 26 is shaped to receive the main body portion 25. The protrusion and recessed features 19, 20 each comprise sloped portions 27, 28 locatable along each longitudinal side of their respective main body 25 and main channel 26 portions. The sloped portions 27, 28 comprise sloped surfaces which each extend longitudinally in a direction generally from a rearward side 22 of the tee to the forward side 21 of the tee. As each of the main body portion 25, main channel portion 26, and sloping portions 27, 28 are disposed generally in a rearward to forward direction, the upper section 11 upon experiencing a force from a golf club, either directly or via a ball located thereon, is encouraged to disengage with the lower section 12 and move in this generally rearward to forward direction. More specifically, the geometry of the protrusion feature 19 and corresponding recessed feature 20 encourage the upper portion to rotate/pivot in the forwards direction and detach from the lower portion. Thus, the sloped portions optimise the intended detachment of the upper and lower sections 11, 12.

Figure 2:
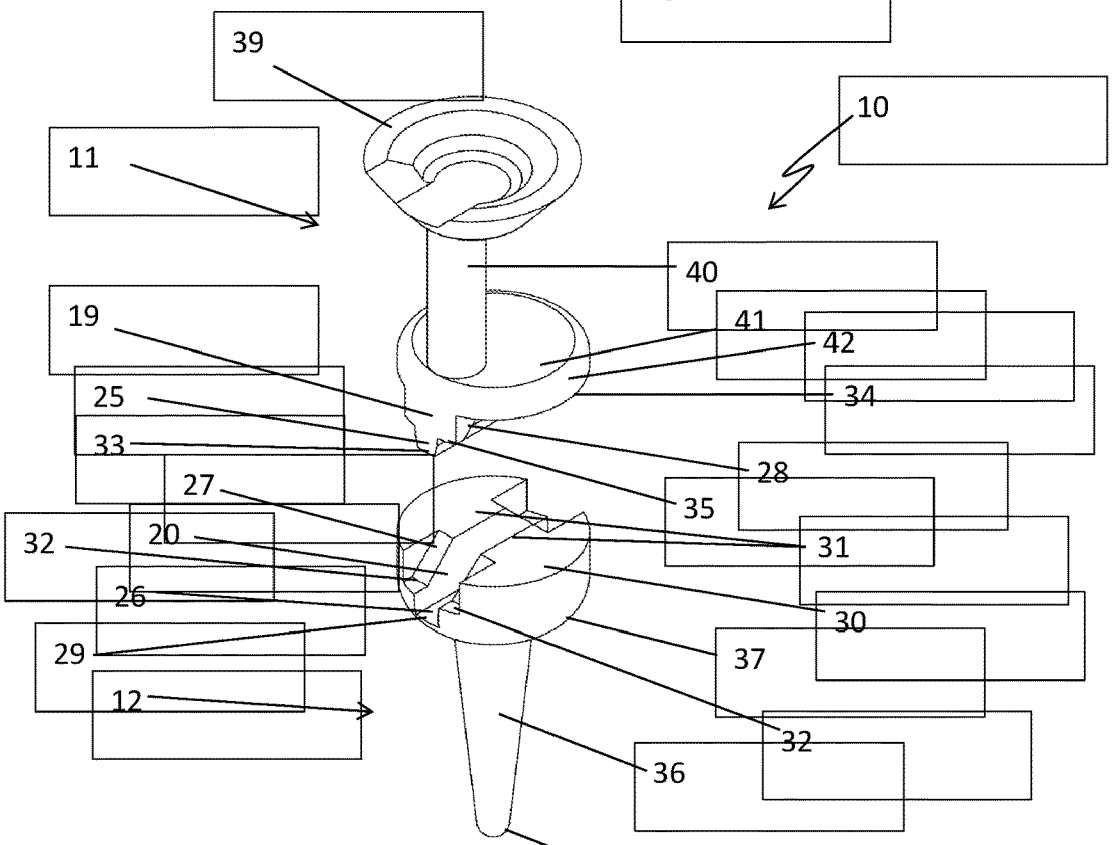
FIG. 2 is a perspective view of the golf tee of FIG. 1 showing the upper section detached from the lower section.
Figure 3:
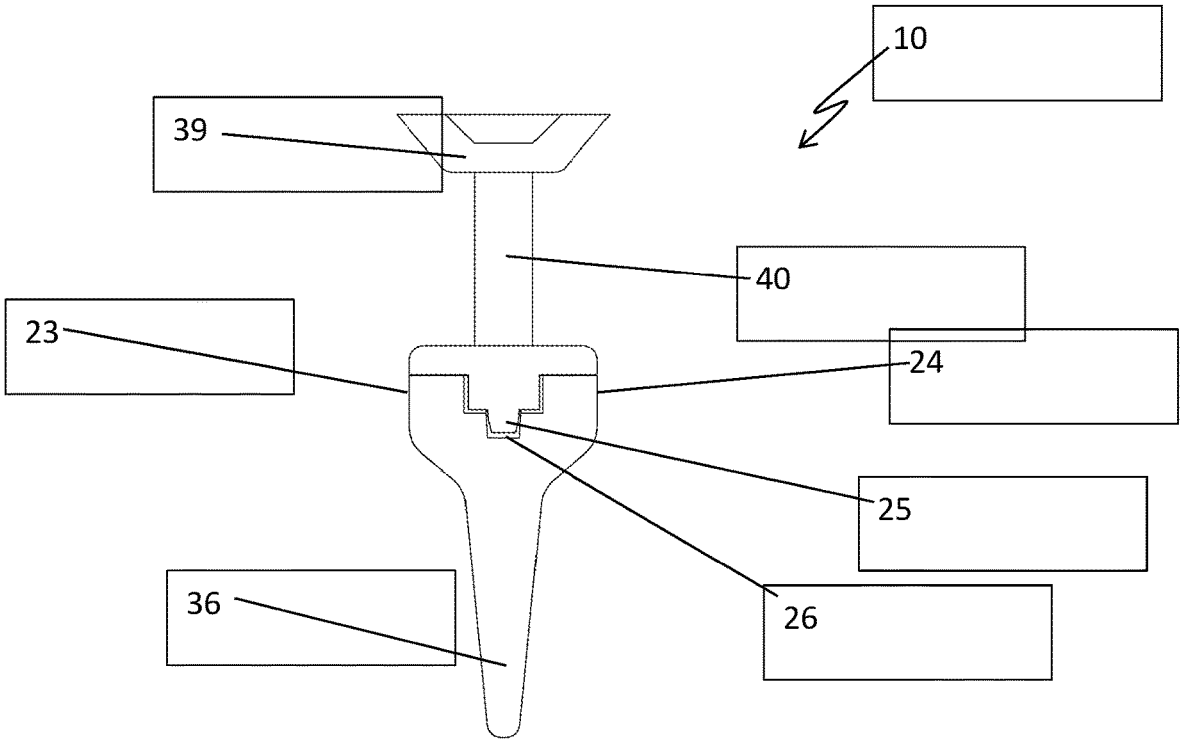
FIG. 3 is a front view of the golf tee of FIG. 1.
Figure 4:
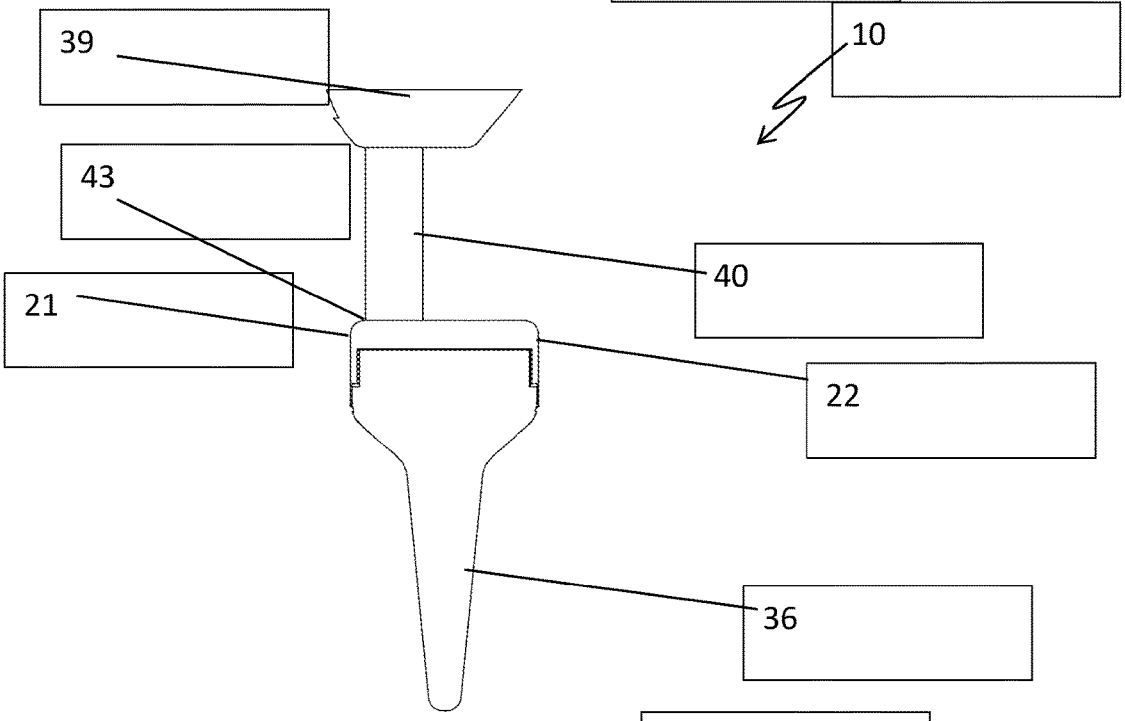
FIG. 4 is a side view of the golf tee of FIG. 1.
Figure 5:
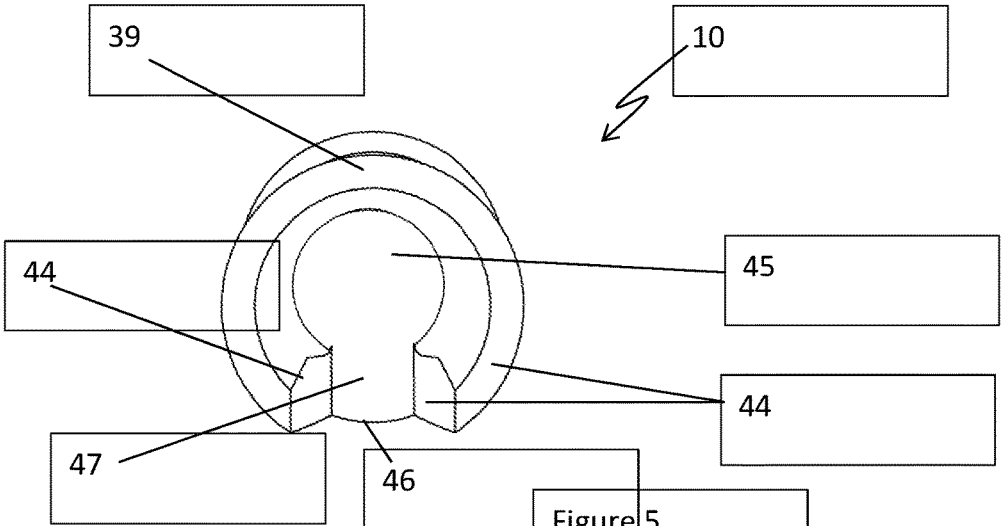
FIG. 5 is a top view of the golf tee of FIG. 1.

The main channel portion 26 of the recessed feature 19 forms a slot 26 running between the rearward side 22 of the lower section 12 and the forward side 21 thereof. A first set of sloped portions 27 extend longitudinally on either side of the slot 26, and generally from the rearward side of the tee 10 and proximal the lowest portion 29 of the slot 26, towards the centre of an upper surface 30 of the second end of the lower section 12. A second set of sloped portions 27 extend longitudinally on either side of the slot 26, generally from the forward side of the tee 10 and proximal the lowest portion 29 of the slot 26, towards the centre of the upper surface 30 of the second end of the lower section 12. The first and second sets of sloping portions 27 may meet at the centre of the upper surface 30 of the second end of the lower section 12, or as shown in the drawings, may terminate prior to the centre of the surface 30 and therefore be separated by a plateau portion 31 extending between the opposing sets of sloping portions 27 (this can be best seen in FIG. 2). The sloped portions 27 need not extend from the base of the slot 26, as can be seen in FIG. 2, the base of the sloped portions may extend parallel to the upper surface 30 of the second end of the lower section 12 to form small plateau features 32. The projection feature 19 is essentially a mirror or reverse arrangement with regards to the recessed feature 20. More specifically, a first set of sloped portions 28 extend longitudinally on either side of the main body portion 25, and generally from the rearward side of the tee 10 and proximal the peak 33 of the main body portion 25, towards the centre of a lower surface 34 of the second end of the upper section 11. A second set of sloped portions 28 extend longitudinally on either side of the main body portion 25, generally from the forward side of the tee 10 and proximal the peak 33 of the main body portion 25, towards the centre of the lower surface 34 of the second end of the upper section 11. The first and second sets of sloping portions 28 may meet at the centre of the lower surface 34 of the second end of the upper section 11, or as shown in the drawings, may terminate prior to the centre of the surface 34 and therefore be separated by a plateau portion extending between the opposing sets of sloping portions 28. The sloped portions 28 need not extend from the peak 33 of the main body portion 25, as can be seen in FIG. 2, the peak of the sloped portions may extend parallel to the lower surface 34 of the second end of the upper section 11 to form small plateau features 35.

The sloped portions 28 of the protrusion feature 19 slope generally in a direction from the underside surface 34 of the second end of the upper section 11, outwardly from said surface 34 to from sloped protrusion portions 28. The sloped portions 27 of the recessed feature 20 slope generally in a direction from an upper surface 30 of the second end of the lower section 11, inwardly from said surface 30 to from sloped recessed portions 27 in said surface 30. The sloped portions 27, 28 of the recessed and protrusion features 19, 20 are correspondingly shaped such that the sloped surfaces 28 of the protrusion feature 19 abut and/or generally align with the sloped surfaces 27 of the recessed feature 20 when the upper and lower portions 11, 12 are engaged via the releasable engagement arrangement 13, 14. The aforementioned optimisation of the releasable engagement element involves careful tolerancing of the protrusion feature 19 and recessed feature 20 such that when mated together a desired level of friction exists therebetween, this level of friction being suitable for forming a unitary tee in the pre-strike condition and permitting detachment of the upper section 11 from the lower section 12 upon a golf club striking the upper section 11 or a ball located thereon. The optimisation further ensures that the detachment of the upper section 11 from the lower section occurs before the upper section 11 has opportunity to provide and significant resistance to the ball as it is struck or to a golf club which strikes the ball. The skilled person would be well aware of tolerancing techniques to form a suitable friction fit arrangement.

It should be understood that the specific geometry of the protrusion feature 19 and recessed feature 19 should not be construed as limiting. The skilled person would understand how to devise alternative geometries for these features 19, 20 which would be suitable for forming an engagement therebetween which would join the upper and lower sections 11, 12 in the pre-strike configuration to form a unitary tee and permit detachment upon striking of the upper section 11 or a ball located on said upper section 11. Moreover, the invention may be implemented with any suitable releasable engagement arrangement between the upper and lower sections 11, 12 which would also fulfil this purpose. The skilled person would be aware of such releasable engagement arrangements. As such the present invention should not be construed as limited to a friction fit connection comprising a projection and corresponding recess.

The lower section 12 comprises a shaft 36 which extends generally centrally from the underside of the second end 18 of the lower section 12 to form the first end 17 of the lower section 12. The central shaft 36 is a tapered shaft such that the lower end 17 of the tapered shaft 36 forms a pointed section 38 which may be used to penetrate the ground. The lower section 12, in use, is insertable into the ground such that at least the shaft 36 thereof is at or below ground level. In preferable embodiments, the lower section 12 is insertable into the ground such that the entirety thereof is at or below ground level. Advantageously, as the lower section 12 is all or mostly at or below ground level, the likelihood of a user striking the lower section 12 during their golf swing is greatly reduced. Thus the possibility that the ground anchored lower section 12 could negatively impact the swing of a golfer by providing resistance as the ball is struck from the golf tee is greatly reduced. This is in contrast to traditional golf tees wherein the resistance provided by the ground is transferred to the ball receiving portion of the tee and as such this resistance may impact swing path, speed, follow through, and/or flight of the ball. In preferred embodiments, the lower section 12 is approximately 2.5 centimetres in height.

A ball receiving feature 39 is locatable at the first end 15 of the upper section 11. The upper section 11 further comprises a shaft 40 extending from an upper surface 41 locatable on the back side of a formation 42, the other side of which comprises the projection element 19. The shaft of the upper portion 40 extends between the surface 41 and the ball receiving feature 39. The shaft 40 of the upper section 11 is laterally offset from the centre of the upper surface 41 in a forward direction. In the most preferred embodiment, the shaft 40 of the upper section 11 is laterally offset from the centre of the upper surface 41 by approximately 4 mm in a forward direction. The forward direction is defined as the direction a ball will generally travel, or at least is intended to travel, once struck form the ball receiving feature 39 of the upper section 11. The shaft of the upper section 40 is therefore also offset from the centrally located shaft 36 of the lower section 12 when the upper and lower sections 11, 12 are engaged in the pre-strike configuration, this is best seen in FIG. 1. Again, in the most preferred embodiment, in the pre-strike configuration as shown in FIG. 1, the shaft of the upper section 40 is offset in a forward direction by 4 mm from the centrally located shaft 36 of the lower section 12. Advantageously, the shaft 40 of the upper section 11 is positioned such that the likelihood of a user striking said shaft 40 during their golf swing is reduced, thus the effect that striking said shaft 40 would have on the clubface and resultantly the path, speed, and/or follow through of a users golf swing is diminished, as is any resulting impact on the direction/flight of the ball. The leading edge of a golf club is the bottom section of the club, which generally projects forward of the top portion thereof and thus is the first portion of the club likely to contact a tee. When this leading edge of the club touches/hits existing tees with a centred shaft during a strike, the golf ball jumps up/moves. If the ball is moving, it's not where it needs to be when the sweet spot, which is generally located in the centre of the clubface, actually contacts with the ball. In this case, the sweet part of the club is hitting an already moving ball which means less accuracy in the shot. To remedy this problem and to ensure that the sweet spot of the club has optimal contact with the ball, the present invention moves the shaft 40 of the upper section 11 forward. Therefore the leading edge/bottom part of a club hits the shaft 40 later than in the case of existing centre shaft tees, therefore the ball doesn't move at all or at least as much when compared to the ball movement when using existing centre shafted tees.

The ball receiving feature 39 is a generally circular ball receiving feature 39 and preferably is a cup shaped ball receiving feature 39 having raised side walls 44 defining a ball receiving cup 45 therein. The raised side walls 44 generally slope from their upper ends downwards towards the centre of the ball receiving cup 45. The outer circumference of the ball receiving feature 39 forms the widest portion of the golf tee 10 when viewed from the top. The wide nature of the ball receiving feature 39 aids in balancing golf all on the tee. The top of the tee 10 is defined as the end having the ball receiving feature 39. The forward side 46 of the ball receiving feature comprises an opening 47 in the raised side walls 44 thereof. The position of this opening 47 is above the off-centre shaft 40 of the upper section 11. In use, this opening 47 is orientated by a user such that it faces in the desired direction of the shot and facilitates a golf ball moving more smoothly off the tee. Advantageously, a ball, once struck, may travel from the golf tee 10 through the opening 47 and thus experience less resistance which could slow or alter the path/flight/direction of the ball. The free movement of the ball also results in less resistance experienced by a golf club as it strikes the ball from the tee. The opening 47 also acts as an alignment aid to aid a user in aligning the golf tee 10 in order that the rearward side of the golf tee 10 is facing in a direction from which the user intends to strike the ball, and/or the forward side of the golf tee 10 is facing in a direction in which the user intends a struck ball to travel. The alignment also ensures that the longitudinal direction of the main body portion 25 and the main channel portion 26 generally align with the intended swing path of a user. To achieve this, the opening 47 is aligned with the forward ends of the main body 25 and main channel portions 26. Correctly aligning the golf tee 10 in this manner ensures that, upon striking a ball from the tee 10, the geometry of the protrusion feature 19 and corresponding recessed feature 20 encourage the upper portion to rotate/pivot in the forwards direction and detach from the lower portion.

Figure 6:
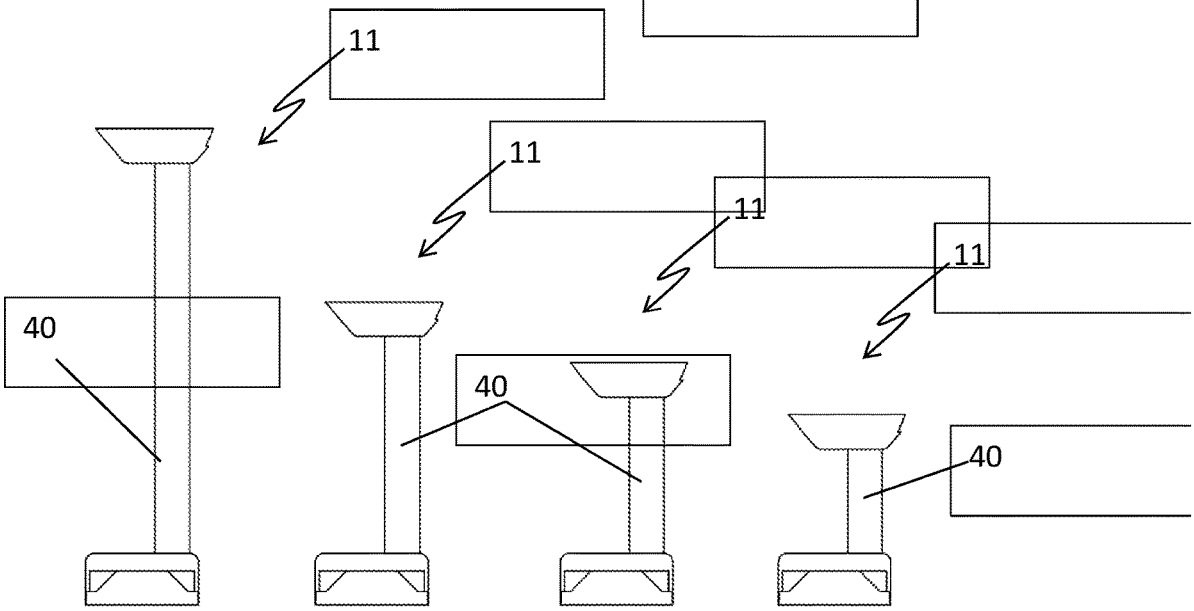
FIG. 6 is a side view of a plurality of upper sections of a golf tee, the upper sections being of differing heights.
Figure 7:
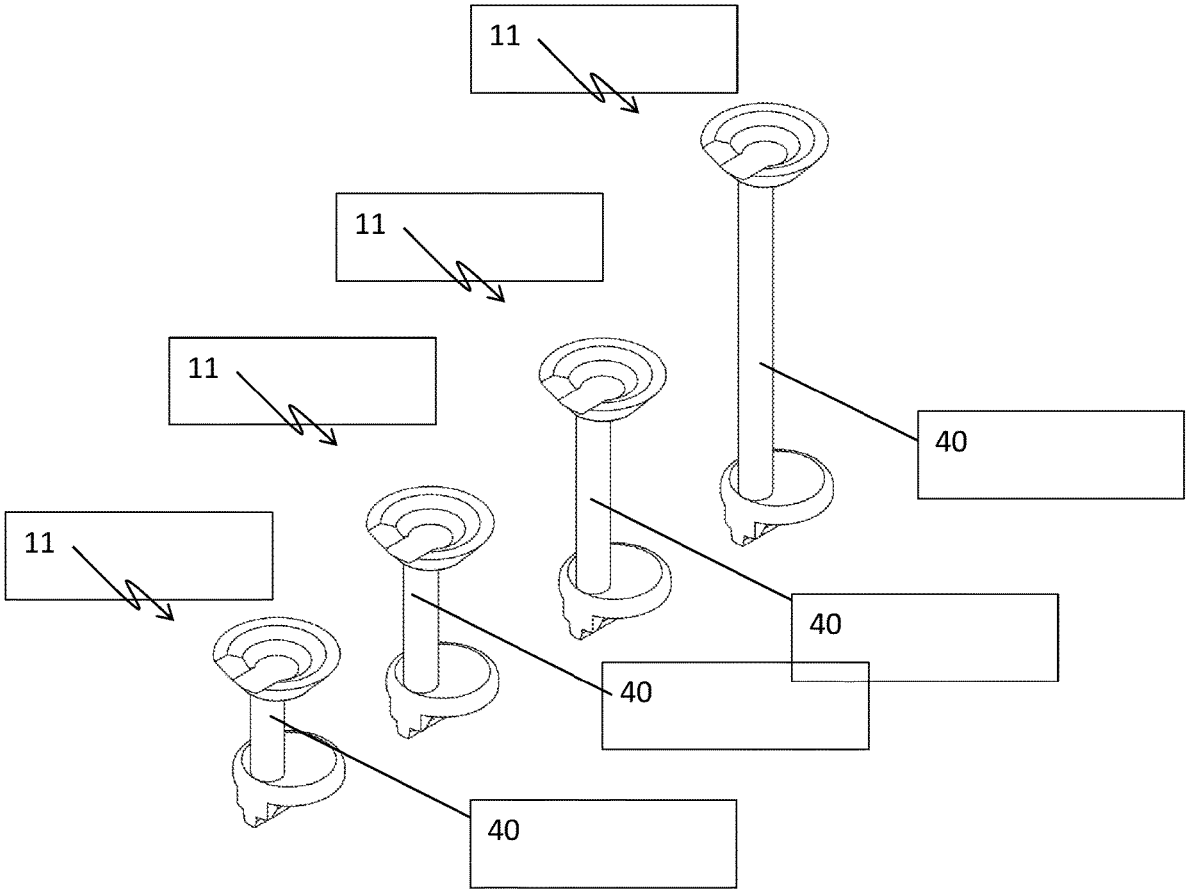
FIG. 7 is a perspective view of the upper sections of FIG. 6.
Figures 8, 9:
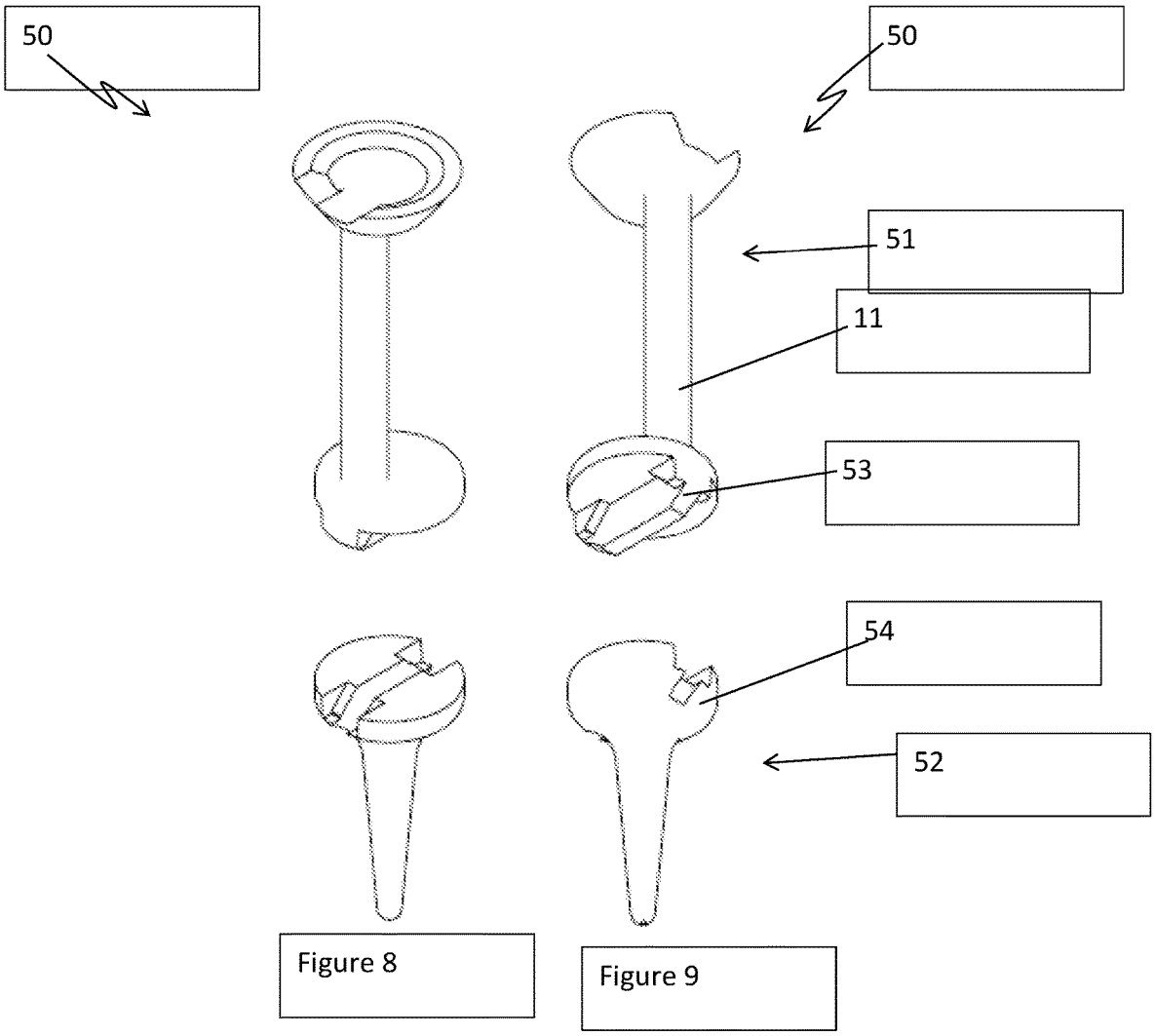
FIG. 8 is a perspective view from above of a further embodiment of a golf tee showing the upper and lower sections thereof in a detached configuration.
FIG. 9 is a perspective view from below of the golf tee of FIG. 8.
Figures 30, 31, 32, 33:
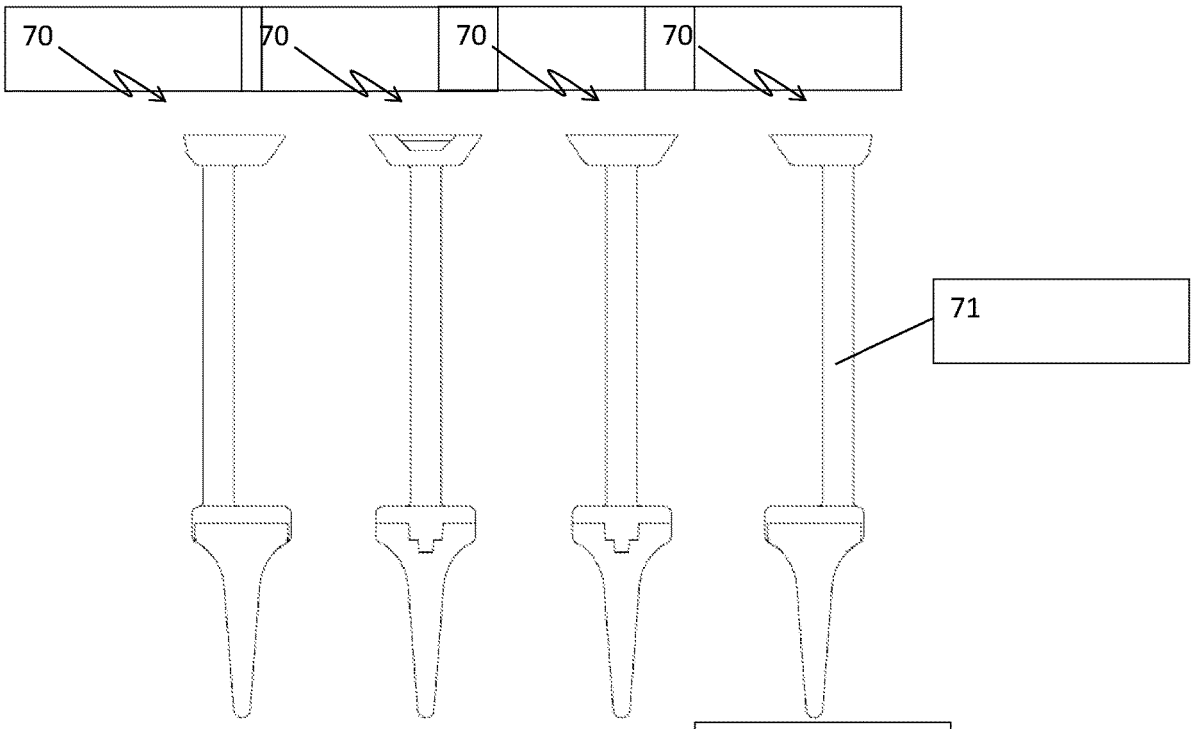
FIG. 30 is a first side view of the golf tee of FIG. 28 showing the upper and lower sections thereof in engagement with each other.
FIG. 31 is a front view of the golf tee of FIG. 30.
FIG. 32 is a rear view of the golf tee of FIG. 30.
FIG. 33 is a second side view of the golf tee of FIG. 30.
Figures 34, 35:
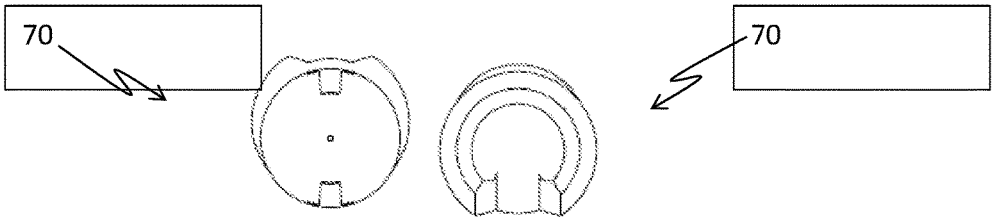
FIG. 34 is a bottom view of the golf tee of FIG. 30.
FIG. 35 is a top view of the golf tee of FIG. 30.
Figures 36, 37:
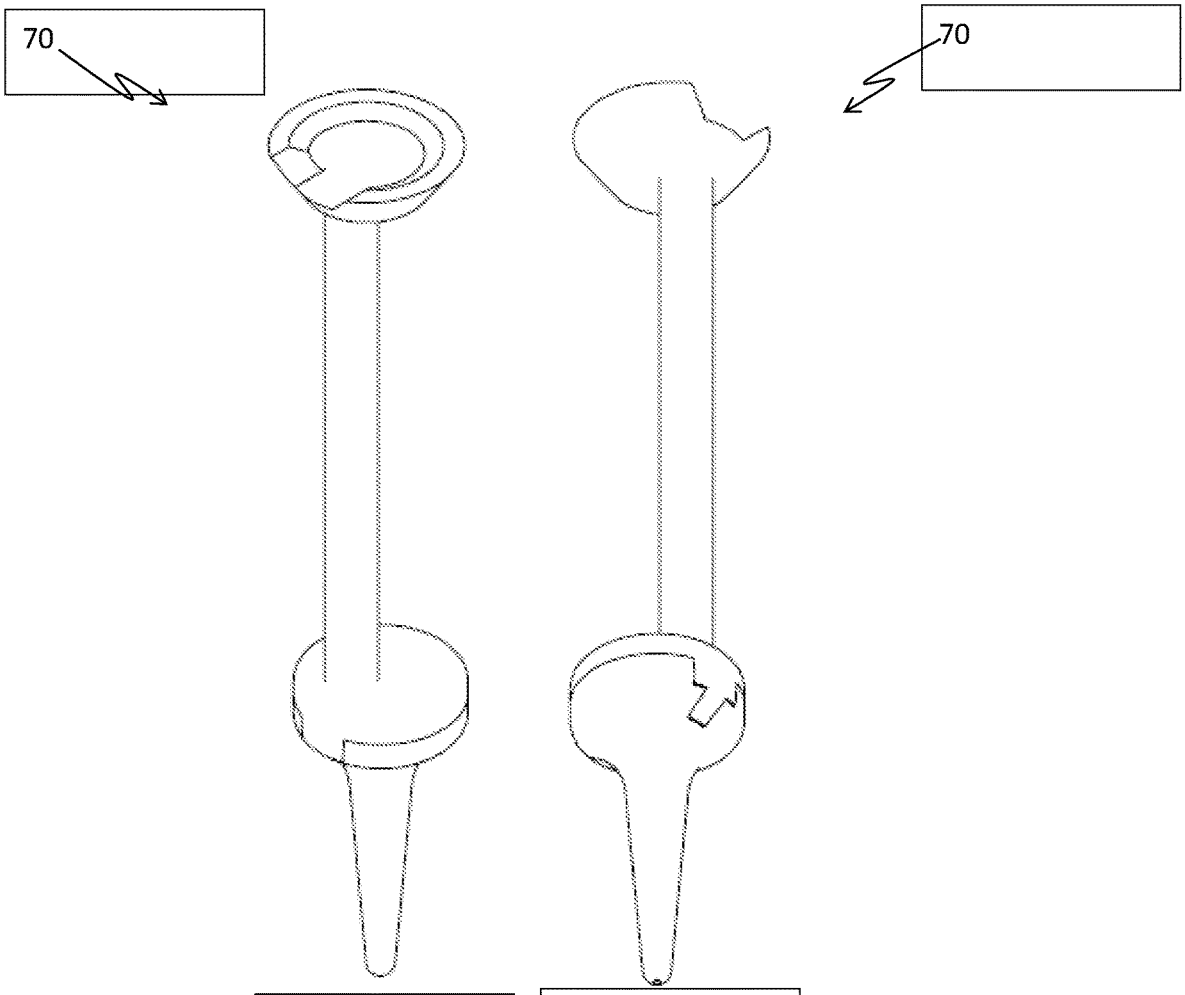
FIG. 36 is a perspective view from above of the golf tee of FIG. 28 showing the upper and lower sections thereof in engagement with each other.
FIG. 37 is a perspective view from below of the golf tee of FIG. 36.

As is best seen in FIGS. 6 and 7, the upper section 11 can be provided in a variety of heights. Advantageously, the overall height of the golf tee 10 can be made suitable for use by different golfers having different tee height preferences, be adapted depending on shot type, or adapted depending on club choice/geometry. The different heights are achieved by providing a plurality of upper sections 11 having shafts 40 of differing lengths. FIGS. 6 and 7 show four examples, however it should be understood that any number of height variants may be provided.

FIGS. 8 to 17 show a further embodiment of a golf tee 50 according to the invention wherein the interface between the upper and lower sections is slightly different from the embodiment as shown in FIGS. 1 to 7. The upper section 51 has a similar protrusion feature 51 to that of the first embodiment, however the protrusion feature 51 has a sloped/contoured side portion 53 which matches the slope/contour of the outer wall of the lower section 52. This can be best viewed in FIG. 9. The contouring of the lower section 53 and provision of corresponding sloped/contoured side portion 53 on the upper section 51 allows for a more optimal engagement between the upper 51 and lower 53 sections such that when engaged the tee 50 maintains integrity for holding of a ball but when struck the upper and lower sections 52, 52 suitable detach to gain the advantages as discussed above. In addition, this contouring/shaping allows for the tee 50 to be more easily manufactured as it simplifies the moulding process. FIGS. 18 to 27 and 28 to 37 show two further embodiments of the design. These embodiments are substantially the same as the embodiment of FIGS. 8 to 17; however the length of the shafts 61, 71 of the upper sections 51 thereof have been differed to provide tees of differing heights. In the embodiments of the drawings, the embodiment of FIGS. 8 to 17 has an overall height of 34.93 mm (1 and ⅜ of an inch), the embodiment of FIGS. 18 to 27 has an overall height of 19.05 mm (¾ of an inch), and the embodiment of FIGS. 28 to 37 has an overall height of 50.8 mm (2 inches). However it should be understood that any height tee may be easily provided by changing the shaft length of the upper section 51.

As is clear from the above description, the tee of the present invention comprises a plurality of features which deliver a straighter, or directionally as intended, strike of a ball off the tee (other factors being constant such as quality of swing of a golfer, correct stance etc). That is, upon striking of the ball the tee itself does not interfere with the ball direction or path such that said ball travels in the intended direction. The tee ensures a straight strike, eliminates/reduces resistance, and ensures sweet spot connect between the club face and ball, the sweet spot being an area of the club face which if hit provides maximal directional control, ball speed, and/or spin rates. When the ball is struck as intended, i.e. a clean strike, the tee facilitates the club of the user to sweep the ball and the upper section of the tee away to deliver a straighter shot.

The invention is not limited to the embodiment(s) described herein but can be amended or modified without departing from the scope of the present invention.

The invention claimed is:

1. A golf tee comprising:

an upper section comprising a ball receiving feature at a first end thereof for receiving a ball;

a lower section configured for penetration of the ground;

wherein the upper and lower sections are releasably engagable with respect to each other via an interlocking releasable engagement arrangement and, in use, the upper section becomes detached from the lower section should a ball positioned on the upper section be struck by a golf club, the interlocking releasable engagement arrangement comprising correspondingly shaped protrusion and recess features locatable on the upper and lower sections, said protrusion and recess features comprising corresponding sloped portions, the sloped portions of the protrusion feature slope generally in a direction from an underside surface of the upper section, outwardly from said underside surface to form sloped protrusion portions, the sloped portions of the recessed feature slope generally in a direction from an upper surface of the lower section, inwardly from said upper surface to form sloped recessed portions in said upper surface, the sloped portions of the upper section having a plurality of sloped surfaces comprising a first sloped surface which slopes away from the underside surface of the upper section longitudinally in a direction generally from a rearward side of the tee to a forward side of the tee and a second sloped surface which slopes in the opposing direction to the first sloped surface, and wherein upon experiencing a force from a golf club via a ball located thereon, the upper section is encouraged to rotate/pivot in the forwards direction and detach from the lower section.

2. The golf tee of claim 1, comprising the interlocking releasable engagement arrangement operable between the upper and lower sections.

3. The golf tee according to claim 2, wherein the upper section comprises first and second portions, the first portion of the upper section being configured to receive a ball, and the lower section comprises first and second portions, at least the first portion of the lower section being configured to penetrate the ground, the interlocking releasable engagement arrangement being locatable at or between the respective second portions of the upper and lower sections, the upper section being releasably engageable with respect to the lower section.

4. The golf tee according to claim 3, wherein the interlocking releasable engagement arrangement comprises a first releasable engagement element thereof on the upper section and a corresponding second releasable engagement element thereof on the lower section.

5. The golf tee according to claim 4, comprising a pre-strike configuration wherein the interlocking releasable engagement arrangement retains the upper section and lower section together to form a unitary tee which is engageable with the ground via the lower section and may receive a ball via the upper section and present said ball for striking by a user, and comprising a post-strike configuration wherein, upon a user striking a ball located on the upper section, or striking the upper section with a golf club, the upper section detaches from the lower section.

6. The golf tee according to claim 5, wherein the interlocking releasable engagement arrangement is optimised, the engagement between the upper and lower sections forming a unitary tee capable of supporting a ball at a distance from the ground, and said engagement being releasable, the upper section detaching from the lower section upon the upper section being subjected to a force level representative of a golf club striking a ball from the golf tee.

7. The golf tee according to claim 1, wherein the interlocking releasable engagement arrangement comprises the first releasable engagement element thereof on the upper section and the second releasable engagement element thereof on the lower section.

8. The golf tee according to claim 7, wherein the interlocking releasable engagement arrangement is a friction fit releasable engagement arrangement and the level of friction between the upper and lower sections is optimised such that the friction level between the upper and lower sections is sufficient in the pre-strike configuration to form a unitary tee capable of supporting a ball at a distance from the ground, and the friction level between the upper and lower sections is such that the upper section detaches from the lower section upon the upper section being subjected to a force level representative of a golf club striking a ball from the golf tee, andwherein the level of friction is such that, in use, the upper section detaches from the lower section before the upper section provides any resistance force to a golf club as the golf club strikes a ball from the golf tee and travels past the golf tee.

9. The golf tee according to claim 7, wherein the first releasable engagement element of the interlocking releasable engagement arrangement comprises a protrusion feature locatable on the second portion of the upper section and the second releasable engagement element of the interlocking releasable engagement arrangement comprises a recessed feature locatable on the second portion of the lower section, wherein the protrusion feature and recessed feature are correspondingly shaped and dimensioned such that insertion of the protrusion feature into the recessed feature releasably retains the upper section in the lower section.

10. The golf tee according to claim 9, wherein the protrusion feature and recessed feature are shaped to encourage detachment of the upper section from the lower section when a detachment force is imparted to the upper section, the direction of said detachment force being generally from a rearward side of the golf tee, the rearward side being the side form which, in use, a golf club would approach to strike a ball from the tee.

11. The golf tee according to claim 9, wherein the protrusion feature comprises a main body portion extending generally from a rearward side of the tee to a forward side of the tee and the recessed feature comprises a corresponding main channel portion extending generally from a rearward side of the tee to the forward side of the tee and configured to receive the main body portion.

12. The golf tee according to claim 11, wherein the protrusion and recessed features each comprise the sloped portions locatable along each longitudinal side of their respective main body and main channel portions.

13. The golf tee according to claim 1, wherein the sloped portions of the protrusion and recessed features are correspondingly shaped to permit the sloped surfaces of the protrusion feature to abut and generally align with the sloped surfaces of the recessed feature when the upper and lower portions are engaged via the releasable engagement arrangement.

14. The golf tee according to claim 4, wherein a second portion of the lower section is located at a second end thereof, the second releasable engagement element being locatable at said second end, and the lower section comprising a shaft which extends generally centrally from the underside of the second releasable engagement element to a first end of the lower section distal the second end thereof.

15. The golf tee according to claim 14, wherein the lower section, in use, is insertable into the ground and at least the shaft thereof is at or below ground level, and the entirety of the lower section is at or below ground level.

16. The golf tee according to claim 4, wherein the second portion of the upper section is located at a second end thereof, the first releasable engagement element being locatable at said second end, a ball receiving feature is locatable at a first end of the upper section distal the second end thereof, and the upper section further comprises a shaft extending between the first releasable engagement element and the ball receiving feature.

17. The golf tee according to claim 16, wherein the shaft of the upper section is locatable laterally offset, in a forward direction, from the centre of an upper surface of the first releasable engagement element, the forward direction being the direction a ball will generally travel once struck from the ball receiving feature of the upper section.

18. The golf tee according to claim 1, wherein the upper section can be provided in a variety of heights such that the overall height of the golf tee can be made suitable for use by different golfers, be adapted depending on shot type, or adapted depending on club choice/geometry, the different heights.

* * * * *